US012146258B2

(12) United States Patent
Lee et al.

(10) Patent No.: US 12,146,258 B2
(45) Date of Patent: Nov. 19, 2024

(54) CLOTHES DRYER

(71) Applicant: SAMSUNG ELECTRONICS CO., LTD., Suwon-si (KR)

(72) Inventors: Seung-Mok Lee, Suwon-si (KR); Sam Young Jang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 838 days.

(21) Appl. No.: 16/975,181

(22) PCT Filed: Feb. 18, 2019

(86) PCT No.: PCT/KR2019/001916
§ 371 (c)(1),
(2) Date: Aug. 24, 2020

(87) PCT Pub. No.: WO2019/164201
PCT Pub. Date: Aug. 29, 2019

(65) Prior Publication Data

US 2020/0399819 A1 Dec. 24, 2020

(30) Foreign Application Priority Data

Feb. 23, 2018 (KR) ..... 10-2018-0021718

(51) Int. Cl.
*D06F 58/04* (2006.01)
*D06F 58/20* (2006.01)

(52) U.S. Cl.
CPC ..... *D06F 58/04* (2013.01); *D06F 58/20* (2013.01)

(58) Field of Classification Search
CPC ..... D06F 58/04; D06F 58/20; F16J 15/3202; F16J 15/3204; F16J 15/027; F16J 15/025; F16J 15/32; F16J 15/3232; F16J 15/3236
See application file for complete search history.

(56) References Cited

U.S. PATENT DOCUMENTS 2,316,713 A * 4/1943 Procter ..... F16J 15/3232 277/553
5,459,945 A * 10/1995 Shulenberger ..... F26B 11/049 34/605

(Continued)

FOREIGN PATENT DOCUMENTS

EP 1 790 768 A2 5/2007
KR 10-2005-0037187 A 4/2005

(Continued)

OTHER PUBLICATIONS

Office Action dated Oct. 28, 2022, in Korean Application No. 10-2018-0021718.

(Continued)

*Primary Examiner* — Edelmira Bosques
*Assistant Examiner* — Bao D Nguyen
(74) *Attorney, Agent, or Firm* — STAAS & HALSEY LLP

(57) ABSTRACT

Provided is a clothes dryer having an improved structure which allows a drying performance to be improved. The clothes dryer includes a cabinet having an inlet, a support frame having a laundry inlet corresponding to the inlet and disposed inside the cabinet, a drum rotatably disposed inside the cabinet and having an opening corresponding to the laundry inlet, and a sealing member disposed between the laundry inlet of the support frame and the opening of the drum, wherein the sealing member includes a seal body having an elastic material.

9 Claims, 10 Drawing Sheets

(56) References Cited

U.S. PATENT DOCUMENTS

| | | | | |
|---|---|---|---|---|
| 9,638,327 | B1 * | 5/2017 | Banowetz | F16J 15/3284 |
| 2011/0221143 | A1 * | 9/2011 | Toth | F16J 15/025 277/549 |

FOREIGN PATENT DOCUMENTS

| | | | | |
|---|---|---|---|---|
| KR | 10-2009-0050440 | | | 5/2009 |
| KR | 20090050440 | A | * | 5/2009 |
| KR | 10-2012-0050633 | A | | 5/2012 |
| KR | 10-2013-0026356 | A | | 3/2013 |
| KR | 10-2014-0004972 | A | | 1/2014 |
| KR | 10-1367400 | B1 | | 2/2014 |

OTHER PUBLICATIONS

International Search Report dated Jun. 10, 2019, in corresponding International Patent Application No. PCT/KR2019/001916, gracias Office Action dated Apr. 5, 2023, in Korean Application No. 10-2018-0021718.

* cited by examiner

CLOTHES DRYER

CROSS-REFERENCE TO RELATED APPLICATIONS

This application is a U.S. National Stage Application which claims the benefit under 35 U.S.C. § 371 of International Patent Application No. PCT/KR2019/001916 filed on Feb. 18, 2019, which claims foreign priority benefit under 35 U.S.C. § 119 of Korean Patent Application 10-2018-0021718 filed on Feb. 23, 2018, in the Korean Intellectual Property Office, the contents of both of which are incorporated herein by reference.

TECHNICAL FIELD

The disclosure relates to a clothes dryer, and more specifically, to a clothes dryer having an improved structure which allows the drying performance to be improved.

BACKGROUND ART

A clothes dryer, which is a home appliance for drying a wet object, dries an object by circulating heated air to pass through a drum containing the object while the drum is rotating at a low speed.

The clothes dryer may include a drum rotatably installed therein, a driving device to drive the drum, a blowing device to blow air into the rotating drum, and a heater provided to heat the air.

An object to be dried is s put into the drum and when the clothes dryer is operated, the drum is rotated by the operation of the driving device, and at the same time, heated air is supplied into the drum by the operations of the heater and the blowing device.

The clothes dryer may further include a front support frame provided to support the drum on the front. When the airtightness between the front support frame and the drum is lowered, wet vapor or lint may flow out of a gap between the front support frame and the drum. The outflow of wet vapor or lint not only degrades the drying performance of the clothes dryer, but also leads to accidents, such as fire.

DISCLOSURE

Technical Problem

One aspect of the disclosure provides a clothes dryer having an improved structure which allows the airtightness between a drum and a front support frame to be improved.

Technical Solution

According to an aspect of the disclosure, there is provided a clothes dryer including: a cabinet having an inlet; a support frame having a laundry inlet corresponding to the inlet and disposed inside the cabinet; a drum rotatably disposed inside the cabinet and having an opening corresponding to the laundry inlet; and a sealing member disposed between the laundry inlet of the support frame and the opening of the drum, wherein the sealing member includes a seal body having an elastic material, and the seal body includes: a base portion disposed on a seal body seating portion formed on the laundry inlet of the support frame; an extension portion extended from one end portion of the base portion in a bent shape and facing an inner surface of the opening of the drum; and a lip portion extended from one end portion of the extension portion in a bent shape, wherein the lip portion has a length shorter than a length of the extension portion.

The seal body seating portion may be formed along a circumference of the laundry inlet of the support frame.

The seal body may include at least one protrusion portion extended from the extension portion toward the base portion.

The sealing member may further include a seal cover coupled to the extension portion and having a fabric material.

The seal cover may make a surface contact with the inner surface of the opening of the drum.

The seal cover may include a plurality of protrusions that make a contact with the inner surface of the opening of the drum.

The extension portion may include a seal cover coupling surface to which the seal cover is coupled, and the seal cover coupling surface may be provided with a plurality of protrusions.

The seal cover may include a drum counterpart surface that faces the inner surface of the opening of the drum, and the drum counterpart surface may be provided with an uneven portion corresponding to the plurality of protrusions.

The support frame may include a separation preventing step protruding from the seal body seating portion and configured to prevent the seal body from being separated from the seal body seating portion.

The seal body may include: a first end portion formed by overlapping the base portion and the lip portion; and a second end portion formed by overlapping the base portion and the extension portion.

The seal body may further include an intermediate wall formed by overlapping the base portion, the extension portion, and the at least one protrusion portion.

According to another aspect of the disclosure, there is provided a clothes dryer including: a cabinet having an inlet; a support frame having a laundry inlet corresponding to the inlet and disposed inside the cabinet; a drum disposed inside the cabinet to be coupled to the support frame and having an opening corresponding to the laundry inlet; and a sealing member disposed between the laundry inlet of the support frame and the opening of the drum, wherein the sealing member includes a seal body having an elastic material, the seal body includes a base portion disposed on a seal body seating portion formed an outer circumferential surface of on the laundry inlet of the support frame; an extension portion extended from one end portion of the base portion in a bent shape and facing an inner surface of the opening of the drum; a lip portion extended from one end portion of the extension portion in a bent shape, and at least one protrusion portion extended from the extension portion toward the base portion, and wherein between the sealing member seating portion of the support frame and the inner circumferential surface of the opening of the drum, a first end portion of the seal body is formed by overlaying two layers including the base portion and the lip portion, a second end portion of the seal body is formed by overlaying two layers including the base portion and the extension portion, and an intermediate wall of the seal body is formed by overlaying three layers including the base portion, at least one protrusion portion, and the extension portion.

The sealing member may further include a seal cover coupled to the extension portion and having a fabric material.

A separation distance between the base portion and the extension portion at the first end portion is greater than a separation distance between the base portion and the extension portion at the second end portion before the drum is coupled to the support frame.

The intermediate wall of the seal body may be positioned between the first end portion of the seal body and the second end portion of the seal body.

A hollow may be formed between the first end portion of the seal body and the second end portion of the seal body, and the at least one protrusion portion may partition the hollow into a plurality of spaces.

The seal cover may make surface contact with the inner circumferential surface of the drum when the drum is coupled to the support frame.

The seal cover may include a plurality of protrusions provided to come in contact with the inner circumferential surface of the drum.

The extension portion may include a seal cover coupling surface to which the seal cover is coupled, and the seal cover coupling surface may include a plurality of protrusions.

The seal cover may include a drum counterpart surface facing the inner circumferential surface of the drum, and the drum counterpart surface may be formed with an uneven portion corresponding to the plurality of protrusions.

Advantageous Effects

As is apparent from the above, by use of a sealing member including a seal body formed of an elastic material and a seal cover formed of a fabric material, the airtightness between the drum and the front support frame can be improved.

By use of the sealing member pressed by the drum and the front support frame to form a hollow, the airtightness between the drum and the front support frame can be improved.

A surface contact between the sealing member and an inner surface of the drum is realized, so that the airtightness between the drum and the front support frame can be improved.

A line contact between the sealing member and an inner surface of the drum is realized, so that the airtightness between the drum and the front support frame can be improved while minimizing a resistance caused by a contact between the drum and the front support frame.

MODES OF THE DISCLOSURE

Hereinafter, preferred embodiments of the disclosure will be described in detail with reference to the accompanying drawings. On the other hand, the terms "front end", "rear end", "upper part", "lower part", "upper end" and "lower end" used in the following description are defined based on the drawings, and the shape and position of each component is not limited by these terms.

Figure 1:
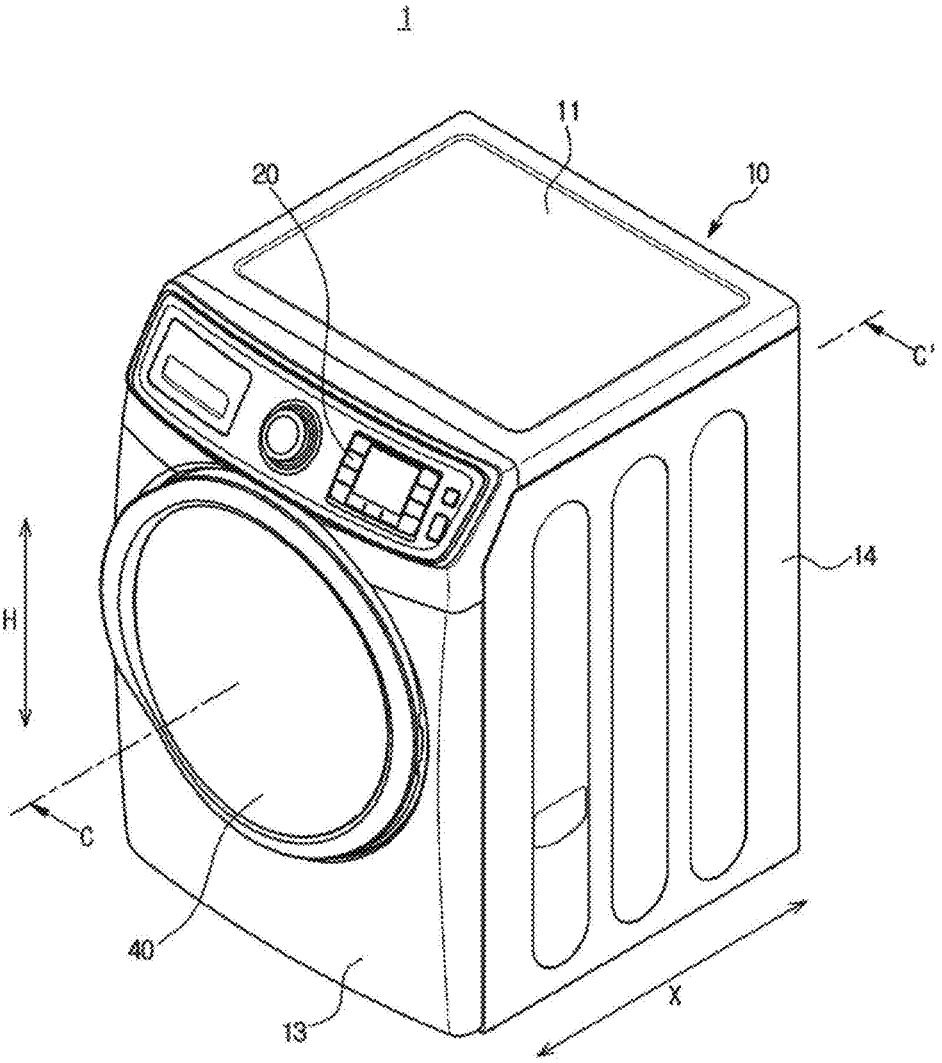
FIG. 1 is a perspective view illustrating a clothes dryer according to an embodiment of the disclosure.
Figure 2:
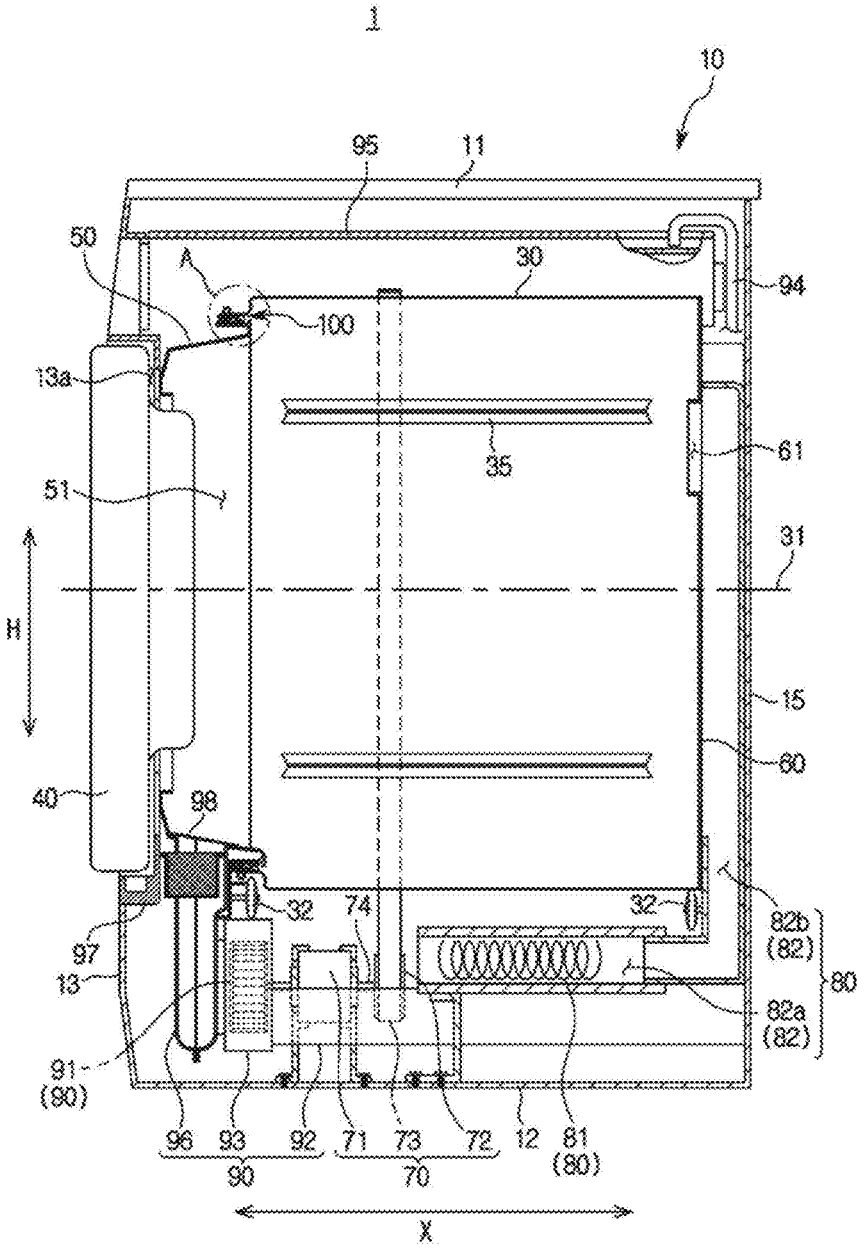
FIG. 2 is a cross-sectional view illustrating the clothes dryer taken line along C-C' of FIG. 1.

FIG. 1 is a perspective view illustrating a clothes dryer 1 according to an embodiment of the disclosure, and FIG. 2 is a cross-sectional view illustrating the clothes dryer 1 taken line along C-C' of FIG. 1.

Referring to FIGS. 1 and 2, the clothes dryer 1 may include a cabinet 10 forming the external appearance thereof.

The cabinet 10 may have a substantially box shape. Specifically, the cabinet 10 may have a top panel 11, a bottom panel 12, a front panel 13, a left side panel (not shown), a right side panel 14, and a rear panel 15. In the present embodiment, the left side panel, the right side panel 14, and the rear panel 15 may be integrally formed with each other, but the disclosure is not limited thereto, and the left side panel, the right side panel 14, and the rear panel 15 may be separately formed and assembled to each other.

The front panel 13 of the cabinet 10 may be formed with an inlet 13*a* through which an object to be dried is introduced into or withdrawn from a drum 30. A laundry inlet 51 to be described below may be formed through a front support frame 50 to correspond to the inlet 13*a*. That is, the laundry inlet 51 to be described below may be formed through the front support frame 50 to communicate with the inlet 13*a*.

A control panel 20 for displaying various pieces of information about the clothes dryer 1 or inputting an operation command may be provided on an upper portion of the front panel 13.

The clothes dryer 1 may further include the drum 30 provided inside the cabinet 10 to accommodate an object to be dried. The drum 30 may be coupled to the front support frame 50 so as to come into contact with a sealing member 100 which will be described below.

The drum 30 may have a substantially cylindrical shape with openings each formed on front and rear surfaces. The drum 30 may be provided inside the cabinet 10 so as to be rotatable about a rotating axis 31. A lifter 35 may be formed on an inner circumferential surface of the drum 30 to lift the object to be dried when the drum 30 is rotated. As the drum 30 rotates, the object to be dried may be repeatedly lifted and fallen by the lifter 35. A roller 32 may be provided on an outer circumferential surface of the drum 30 such that the drum 30 is supported to smoothly rotate.

The clothes dryer 1 may further include a door 40 provided to open and close the inlet 13*a*. The door 40 may be rotatably installed on the front panel 13 of the cabinet 10.

The clothes dryer 1 may further include support frames 50 and 60 provided to support the drum 30. The support frames 50 and 60 may be disposed between the cabinet 10 and the drum 30. The support frames 50 and 60 include the front support frame 50 provided to rotatably support a front end portion of the drum 30 and a rear support frame 60 provided to rotatably support a rear end portion of the drum 30. The front support frame 50 may be fixedly installed on the front panel 13 of the cabinet 10 so as to be positioned between the front panel 13 of the cabinet 10 and the front end portion of the drum 30. The rear support frame 60 may be fixedly installed on the rear panel 15 of the cabinet 10 so as to be positioned between the rear panel 15 of the cabinet 10 and the rear end portion of the drum 30.

The support frames 50 and 60 may be formed with the laundry inlet 51. Specifically, the front support frame 50 may be formed with the laundry inlet 51. The object to be dried may be introduced into the drum 30 through the laundry inlet 51.

The rear support frame 60 may be formed with an intake port 61, through which high temperature dry air capable of drying an object to be dried is introduced into the drum 30.

The clothes dryer 1 further includes the sealing member 100 (see FIG. 3) disposed between the drum 30 and the front support frame 50 to maintain the airtightness between the drum 30 and the front support frame 50. When the sealing between the drum 30 and the front support frame 50 is not properly achieved, lint or vapor that may occur in the process of drying the object to be dried may flow out of a gap between the drum 30 and the front support frame 50. Such lint or vapor may not only degrade the drying performance of the clothes dryer 1 but also cause a safety accident, such as a fire. Therefore, it is very important to secure the airtightness between the drum 30 and the front support frame 50 using the sealing member 100.

The sealing member 100 may not only maintain airtightness between the drum 30 and the front support frame 50, but may also serve to reduce frictional resistance between the drum 30 and the front support frame 50.

The detailed description of the sealing member 100 will be described below.

The clothes dryer 1 may further include a driving unit 70 provided to rotate the drum 30.

The driving unit 70 includes a driving motor 71 installed at an inner lower portion of the cabinet 10, and a pulley 72 and a belt 73 for transmitting the power of the driving motor 71 to the drum 30. The pulley 72 is connected to a rotating shaft 74 connected to the driving motor 71. When the rotating shaft 74 is rotated by the driving motor 71, the pulley 72 may be rotated together with the rotating shaft 74. The belt 73 may be installed to be wound around an outer surface of the pulley 72 and an outer surface of the drum 30. When the belt 73 is rotated by the driving force of the driving motor 71, the drum 30 may be rotated together with the belt 73.

The clothes dryer 1 may further include a hot air supply unit 80 for supplying hot air into the drum 30.

The hot air supply unit 80 may include a heater 81 provided to heat intake air and an intake duct 82 through which air heated by the heater 81 is guided to flow into the drum 30.

The intake duct 82 includes a lower intake duct 82*a* installed at a lower side of the drum 30 and a rear intake duct 82*b* installed at a rear side of the drum 30 to connect the intake port 61 and the lower intake duct 82*a*. In FIG. 2, the heater 81 is illustrated as being located in the lower intake duct 82*a*, but the position of the heater 81 is not limited thereto, and may be variously changed. As an example, the heater 81 may be located in the rear intake duct 82*b*.

The clothes dryer 1 may further include a hot air discharge unit 90 provided to discharge the air having dried the object in the drum 30.

Hot and dry air is supplied into the drum 30 by the hot air supply unit 80, and the object inside the drum 30 may be dried by the hot and dry air. The air having dried the object becomes hot and humid, and the hot and humid air in the drum 30 may be discharged to the outside of the drum 30 through the hot air discharge unit 90.

The hot air discharge unit 90 may include a fan 91 provided to suck in the hot and humid air in the drum 30 and an exhaust duct 92 provided to guide the air sucked by the fan 91 to be discharged to the outside. The fan 91 may be accommodated in a blower case 93.

The hot and humid air introduced into the exhaust duct 92 may be guided to a heat exchanger (not shown) such that moisture of the hot and humid air is removed. The moisture condensed in the heat exchanger may be pumped by a condensate pump (not shown) and pass through a condensation flow path 94 and flow into a condensate receiving portion 95. The condensate receiving portion 95 may be provided to be withdrawn from the front of the cabinet 10. The user may separate the condensate receiving portion 95 from the cabinet 10 and discard the water stored in the condensate receiving portion 95 as needed.

The air having the moisture removed while passing through the heat exchanger is heated by the heater 81 and flows back into the drum 30 through the intake duct 82 to dry an object to be dried.

The hot air discharge unit 90 may further include a filter duct 96 installed on a lower side of the front support frame 50 and having one side communicate with the inside of the drum 30 and the other side communicate with the blower case 93. In other words, the hot air discharge unit 90 may further include the filter duct 96 installed on the lower side of the drum 30 and having one side communicate with the inside of the drum 30 and the other side communicate with the blower case 93. The filter duct 96 may be provided with a filter device 97 for filtering out various foreign substances contained in the air flowing into the filter duct 96. The filter device 97 may be installed in the cabinet 10 to be retracted or extracted.

The air having dried the object in the drum 30 may be discharged to the filter duct 96. The air introduced into the filter duct 96 may have foreign matter filtered out by the filter device 97. A filter grille 98 in the form of a mesh may be installed at an inlet of the filter duct 96.

Figure 3:
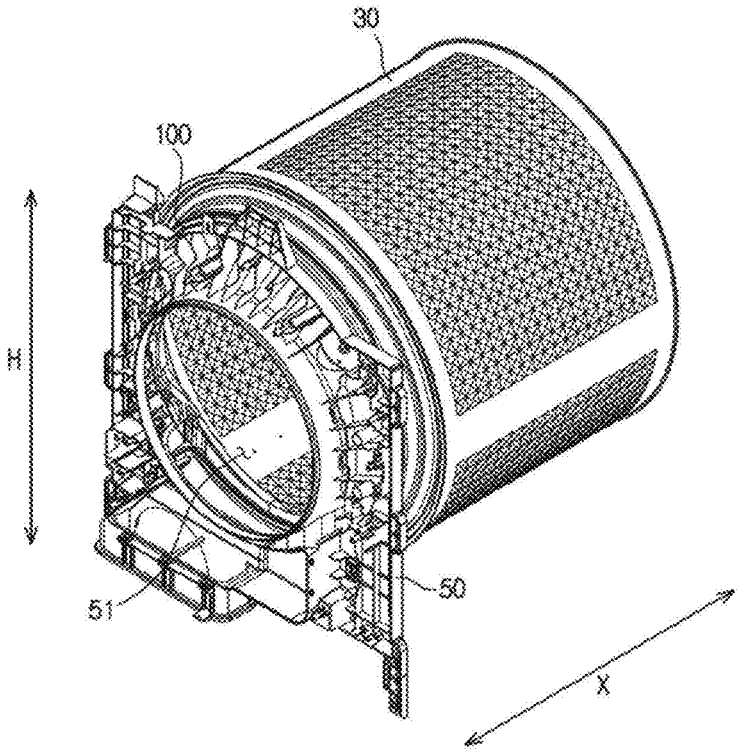
FIG. 3 is a view illustrating the clothes dryer according to the embodiment of the disclosure, which shows a front support frame, a sealing member, and a drum that are assembled.
Figure 4:
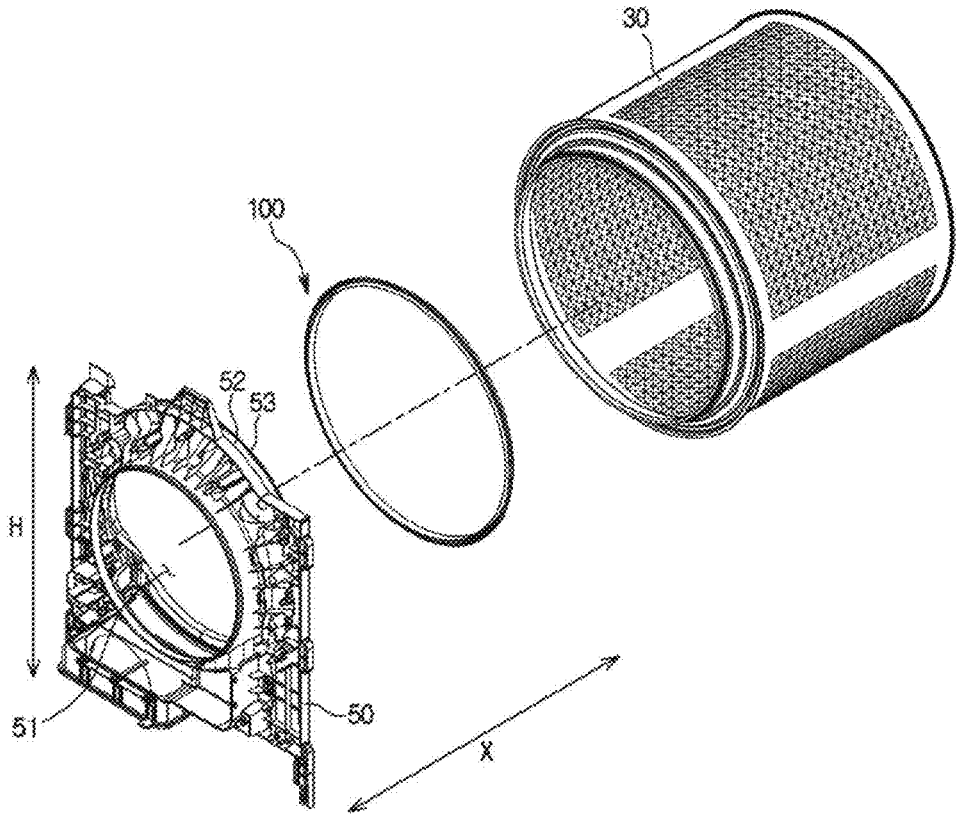
FIG. 4 is a view illustrating the clothes dryer according to the embodiment of the disclosure, which shows the front support frame, the sealing member, and the drum that are disassembled.

FIG. 3 is a view illustrating the clothes dryer according to the embodiment of the disclosure, which shows the front support frame, the sealing member, and the drum that are assembled, and FIG. 4 is a view illustrating the clothes dryer according to the embodiment of the disclosure, which shows the front support frame, the sealing member, and the drum that are disassembled.

Referring to FIGS. 3 and 4, the sealing member 100 may be interposed between the drum 30 and the front support frame 50. The sealing member 100 may be disposed between the laundry inlet 51 of the support frame 50 and the opening of the drum 30. The sealing member 100 may be coupled to the front support frame 50 to seal a gap between the drum 30 and the front support frame 50.

The front support frame 50 may include a sealing member seating portion 52 formed to allow the sealing member 100 to be seated thereon. The sealing member seating portion 52 may be termed a seal body seating portion 52, which will be described below, or vice versa. The sealing member seating portion 52 may be formed at the laundry inlet 51 of the front support frame 50 such that the sealing member 100 is seated on the sealing member seating portion 52. Specifically, the sealing member seating portion 52 may be formed along the circumference of the laundry inlet 51 of the front support frame 50. The sealing member seating portion 52 may be formed on the outer circumferential surface of the laundry inlet 51 of the front support frame 50. The sealing member seating portion 52 may extend from the front support frame 50 in a direction of a rotating axis X of the drum 30 toward the drum 30. The sealing member seating portion 52 may have a shape corresponding to the sealing member 100. As an example, the sealing member seating portion 52 may have an annular shape such that the sealing member 100 of annual shape may be seated on the sealing member seating portion 52. The sealing member seating portion 52 may have a flat surface to make surface contact with the sealing member 100. Specifically, the sealing member seating portion 52 may have a flat surface to make surface contact with a seal body 110 of the sealing member 100.

The front support frame 50 may further include a separation preventing step 53 protruding from the sealing member seating portion 52 to prevent the sealing member 100 from being separated from the sealing member seating portion 52. The separation preventing step 53 may be extended from the sealing member seating portion 52 by a predetermined height in a height direction H of the clothes dryer 1.

The sealing member 100 may have a closed loop shape. As an example, the sealing member 100 may have an annular shape.

The sealing member 100 may include the seal body 110 (see FIG. 5A) having an elastic material. As an example, the seal body 110 may have a material, such as rubber or silicone.

The sealing member 100 may further include a seal cover 120 (see FIG. 5A) having a textile material. The seal cover 120 may be coupled to the seal body 110. As an example, the seal cover 120 may be sewn into the seal body 110 such that one side of the seal cover 120 is fixed to the seal body 110. However, the method of coupling the seal cover 120 to the seal body 110 is not limited to the above example, and may be variously provided.

Hereinafter, various embodiments of the sealing member 100 will be described.

Figure 5A:
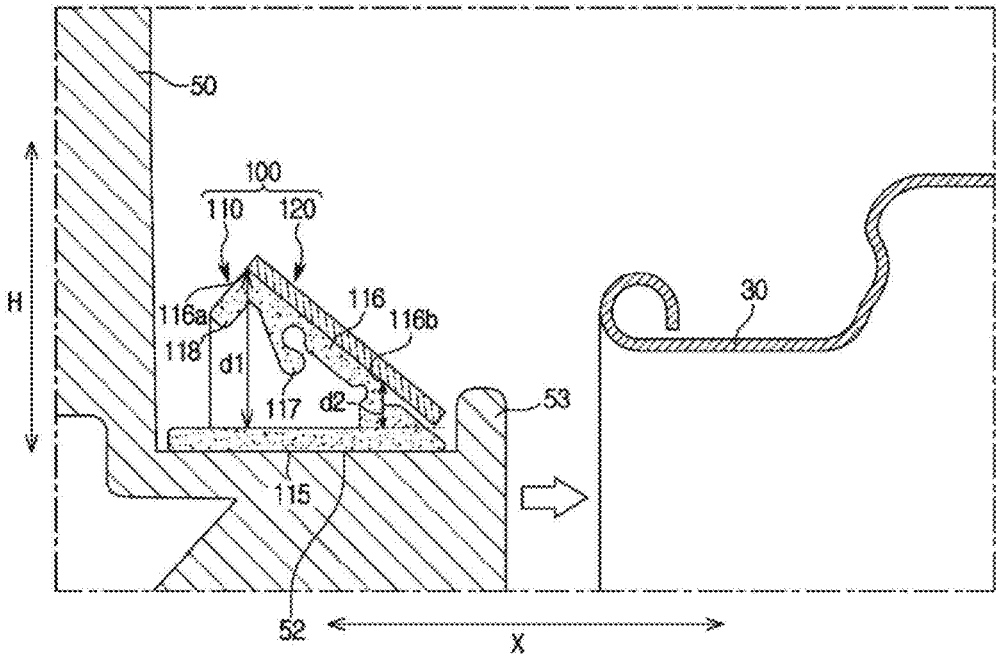
FIGS. 5A and 5B are views illustrating the clothes dryer according to the embodiment of the disclosure, which shows states of the sealing member before and after the front support frame and the drum are coupled.
Figure 5B:
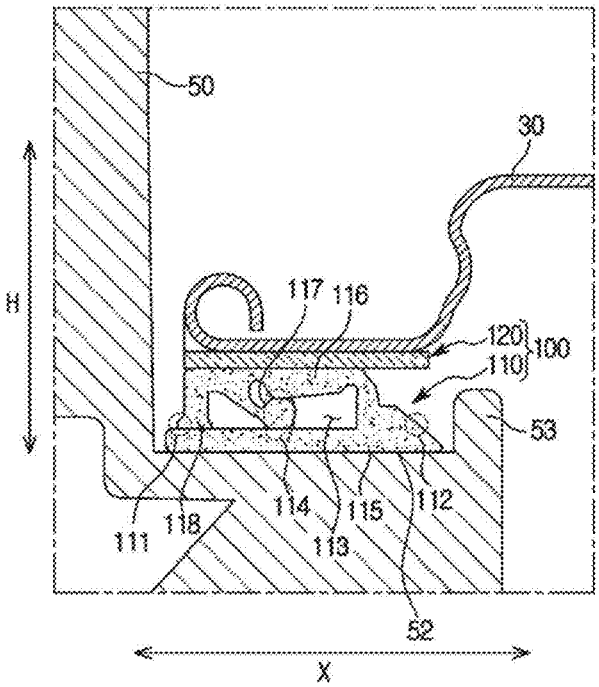

FIGS. 5A and 5B are views illustrating the clothes dryer according to the embodiment of the disclosure, which shows states of the sealing member before and after the front support frame and the drum are coupled. FIG. 5B is an enlarged view of part "A" of FIG. 2. Hereinafter, a base portion may be termed a first part, or vice versa. In addition, an extension portion may be termed a second part or vice versa. In FIG. 5A, "d1" denotes a separation distance between a first end portion 116*a* of the extension portion 116 and the base portion 115, and "d2" denotes a separation distance between a second end portion 116*b* of the extension portion 116 and the base portion 115.

Referring to FIGS. 5A and 5B, the seal body 110 of the sealing member 100 may be folded when the drum 30 is coupled to the front support frame 50. In other words, the seal body 110 of the sealing member 100 may be overlayered when the drum 30 is coupled to the front support frame 50.

The seal body 110 of the sealing member 100 may include a first end portion 111 that is formed by folding of the seal body 110 such that the first end portion 111 is positioned at a front in the rotating axis direction X of the drum 30. The first end portion 111 of the seal body 110 may be adjacent to the laundry inlet 51.

The seal body 110 of the sealing member 100 may include a second end portion 112 that is formed by folding of the seal body 110 such that the second end portion is positioned at a rear in the rotating axis direction X of the drum 30. The second end portion 112 of the seal body 110 may be located on the opposite side of the first end portion 111 of the seal body 110 in the rotating axis direction X of the drum 30.

The seal body 110 of the sealing member 100 may further include a plurality of hollows 113 formed between the first end portion 111 and the second end portion 112. The plurality of hollows 113 may be formed when the drum 30 is coupled to the front support frame 50 to cause the sealing member 100 to be pressed by the front support frame 50 and the drum 30. When the clothes dryer 1 operates, air inside the plurality of hollows 113 may be heated and expanded at the same time. Accordingly, the sealing property of the sealing member 100 may be further improved.

The seal body 110 of the sealing member 100 may further include an intermediate wall 114 positioned between the first end portion 111 and the second end portion 112 to define the plurality of hollows 113. The intermediate wall 114 may be formed by folding of the seal body 110 so as to be positioned between the first end portion 111 and the second end portion 112. Preferably, the seal body 110 of the sealing member 100 may include at least one intermediate wall 114.

The intermediate wall 114 may be formed by folding or overlaying of the seal body 110 to have more layers than layers of the first end portion 111 and the second end portion 112. In other words, the intermediate wall 114 may be formed by folding or overlaying of the seal body 110 such that the intermediate wall 114 has more layers than layers of the first end portion 111 and the second end portion 112 in the height direction H of the clothes dryer 1. As an example, when the first end portion 111 and the second end portion 112 each have two layers in the height direction H of the clothes dryer 1, the intermediate wall 114 may have three layers in the height direction H of the clothes dryer 1. In other words, between the sealing member seating portion 52 of the front support frame 50 and the inner circumferential surface of the opening of the drum 30, the first end portion 111 of the seal body 110 formed by overlaying two layers including the base portion 115 and a lip portion 118, the second end portion 112 of the seal body 110 formed by overlaying two layers including the base portion 115 and the extension portion 116, and the intermediate wall 114 of the seal body 110 formed by overlaying three layers including the base portion 115, at least one protrusion portion 117 and the extension portion 116 may be provided. However, the number of layers forming the first end portion 111, the second end portion 112, and the intermediate wall 114 is not limited to the above example, and may be variously provided.

The first end portion 111 and the second end portion 112 may be formed by folding or overlaying of the seal body 110 to have the same number of layers in the height direction H of the clothes dryer 1. However, the first end portion 111 and the second end portion 112 may be formed by folding or overlaying of the seal body 110 to have different numbers of layers in the height direction H of the clothes dryer 1.

The seal body 110 of the sealing member 100 may further include the base portion 115 coupled to the seal body seating portion 52. The base portion 115 may continuously come into close contact with the seal body seating portion 52. In other words, the base portion 115 may be come into close contact with the seal body seating portion 52 without a gap or hollow between the seal body seating portion 52 and the base portion 115. The base portion 115 may have a flat surface corresponding to the seal body seating portion 52.

The seal body 110 of the sealing member 100 may further include the extension portion 116 to be extended from one end portion of the base portion 115 to face the base portion 115. The extension portion 116 may be extended from one end portion of the base portion 115 in a bent shape to face the base portion 115.

The extension portion 116 includes the first end portion 116*a* positioned on the front side in the rotating axis direction X of the drum 30 and the second end portion 116*b* positioned on the rear side in the rotating axis direction X of the drum 30. The first end portion 116*a* and the second end portion 116*b* of the extension portion 116 may be defined as portions each that come in contact with the seal cover 120. The first end portion 116*a* of the extension portion 116 may be adjacent to the laundry inlet 51. The second end portion 116*b* of the extension portion 116 may be connected to the base portion 115.

The extension portion 116 may be extended from one end portion of the base portion 115 to form a predetermine inclination angle before the drum 30 is coupled to the front support frame 50, as shown in FIG. 5A. In other words, the separation distance between the base portion 115 and the extension portion 116 at the first end portion 111 of the seal body 110 is greater than the separation distance between the base portion 115 and the extension portion 116 at the second end portion 112 of the seal body 110. Specifically, the separation distance between the base portion 115 and the extension portion 116 in the height direction H of the clothes dryer 1 may increase as being directed from the second end portion 116*b* of the extension portion 116 to the first end portion 116*a* of the extension portion 116. In other words, the first end portion 116*a* of the extension portion 116 is located at a position higher than the position of the second end portion 116*b* of the extension portion 116 in the height direction H of the clothes dryer 1 with respect to the base portion 115 before the drum 30 is coupled to the front support frame 50. With such a configuration of the extension portion 116, the sealing member 100 may serve as a guide for the drum 30 such that the drum 30 is easily coupled to the front support frame 50 in a process of the drum 30 being coupled to the front support frame 50.

The seal body 110 of the sealing member 100 may further include the lip portion 118 that is extended from one end of the extension portion 116 in a bent shape. The length of the lip portion 118 may be shorter than the length of the extension portion 116.

The seal body 110 of the sealing member 100 may further include at least one protrusion portion 117 extended downward from the extension portion 116 in the height direction H of the clothes dryer 1. In other words, the at least one protrusion 117 may be extended from the extension portion 116 toward the base portion 115.

The first end portion 111 and the second end portion 112 may be defined by the base portion 115, the lip portion 118, and the extension portion 116. The first end portion 111 may be formed by contact of the lip portion 118 and the base portion 115. In other words, the first end portion 111 may be formed by overlapping the base portion 115 and the lip portion 118. Specifically, when the drum 30 is coupled to the front support frame 50, the sealing member 100 is pressed by the drum 30 and the front support frame 50, and in this case, the lip portion 118 comes into contact with the base portion 115. That is, the lip portion 118 is spaced apart from the base portion 115 before the drum 30 is coupled to the front support frame 5 as shown in FIG. 5A, and the lip portion 118 is caused to come into contact with the base portion 115 to define the first end portion 111 when the drum 30 is coupled to the front support frame 50 as shown in FIG. 5B.

The second end portion 112 may be defined by the extension portion 116 and the base portion 115. The second end portion 112 may be formed by overlapping the extension portion 116 and the base portion 115. Specifically, the extension portion 116 may be extended from the base portion 115 in a bent shape at the second end portion 112.

The intermediate wall 114 may be defined by the base portion 115, the extension portion 116, and the at least one protrusion portion 117. The intermediate wall 114 may be formed by overlapping the base portion 115, the extension portion 116, and the at least one protrusion portion 117. Specifically, when the drum 30 is coupled to the front support frame 50, the sealing member 100 is pressed by the drum 30 and the front support frame 50, and in this case, the at least one protrusion 117 is caused to come into contact with the base portion 115 and the extension portion 116. That is, the at least one protrusion portion 117 is spaced apart from the base portion 115 before the drum 30 is coupled to the front support frame 50 as shown in FIG. 5A, and the at least one protrusion portion 117 is caused to come into contact with the base portion 115 and the extension portion 116 to define the intermediate wall 114 when the drum 30 is coupled to the front support frame 50 as shown in FIG. 5B.

The seal cover 120 may be coupled to the extension portion 116 of the seal body 110. The seal cover 120 may be coupled to the extension portion 116 of the seal body 110 to face the inner surface of the drum 30. In other words, the seal cover 120 may be coupled to the extension portion 116 of the seal body 110 to face the inner surface of the opening of the drum 30. The seal cover 120 may make surface contact with the inner surface of the drum 30 when the drum 30 is coupled to the front support frame 50 as shown in FIG. 5B. In other words, when the drum 30 is coupled to the front support frame 50 as shown in FIG. 5B, the seal cover 120 may make surface contact with the inner circumferential surface of the opening of the drum 30.

Referring to FIG. 5A, before the drum 30 is coupled to the front support frame 50, the seal body 110 of the sealing member 100 does not form the hollow 113.

Referring to FIG. 5B, when the drum 30 is coupled to the front support frame 50, the sealing member 100 is pressed by the drum 30 and the front support frame 50 such that the seal body 110 of the sealing member 100 forms the hollow 113. That is, when the drum 30 is coupled to the front support frame 50, the base portion 115 and the extension portion 116 of the seal body 110 may be coupled to each other to form the hollow 113. In this case, the at least one protrusion 117 of the seal body 110 is bent to come into close contact with the base portion 115 and the extension portion 116 between the base portion 115 and the extension portion 116 to divide the hollow 113 into a plurality of spaces.

Figure 6A:
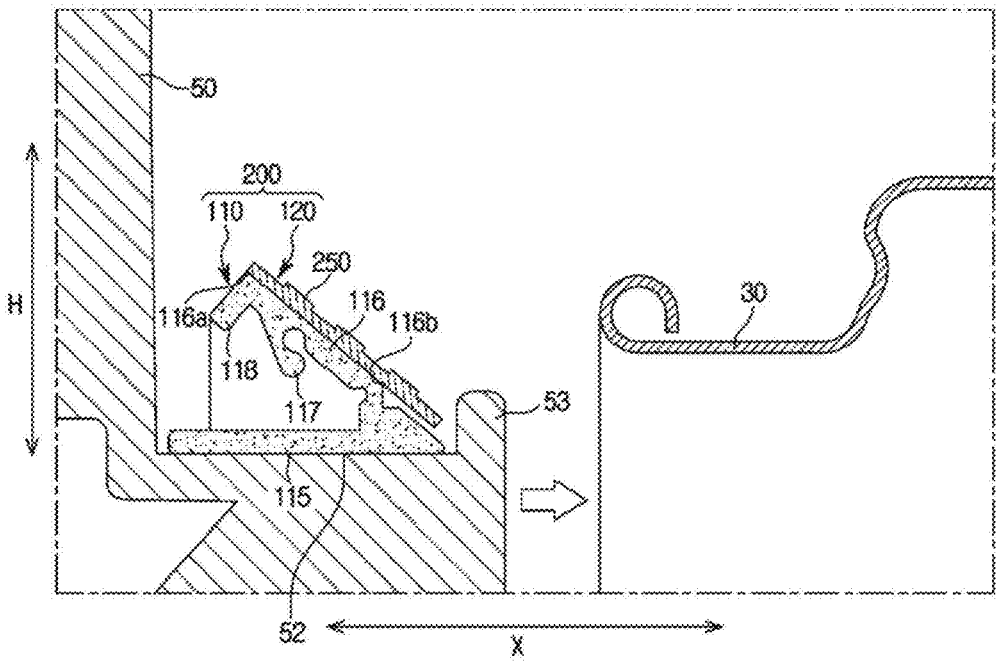
FIGS. 6A and 6B are views illustrating a clothes dryer according to another embodiment of the disclosure, which shows states of a sealing member before and after a front support frame and a drum are coupled.
Figure 6B:
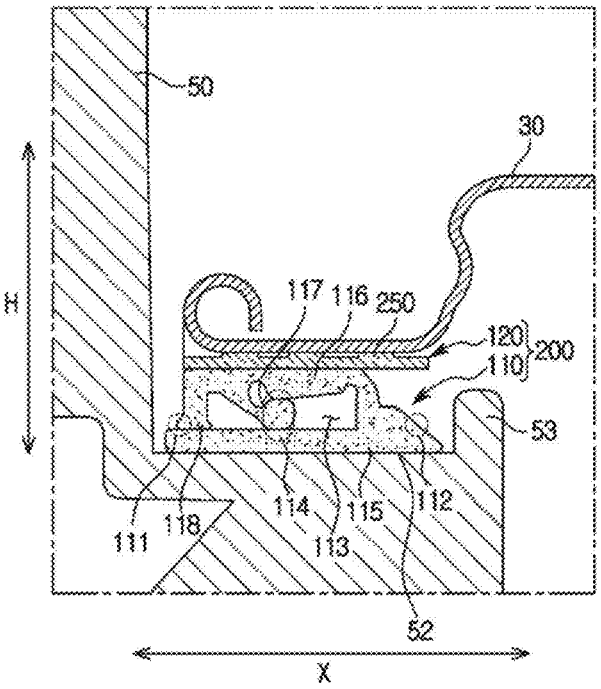

FIGS. 6A and 6B are views illustrating a clothes dryer according to another embodiment of the disclosure, which shows states of a sealing member before and after a front support frame and a drum are coupled. In the following description, parts identical to those described in FIGS. 5A and 5B may be omitted, and may be assigned the same reference numerals.

Referring to FIGS. 6A and 6B, a seal cover 120 may include a plurality of protrusions 250 provided to come into contact with the inner surface of a drum 30. In other words, the seal cover 120 may include a plurality of protrusions 250 provided to come into contact the inner surface of the opening of the drum 30. In this case, the plurality of protrusions 250 of the seal cover 120 may allow a sealing member 200 to make line contact with the inner surface of the drum 30. As such, the plurality of protrusions 250 formed on the seal cover 120 may allow the sealing between the sealing member 200 and the inner surface of the drum 30 to be kept while minimizing the resistance due to contact between the sealing member 200 and the inner surface of the drum 30.

Figure 7A:
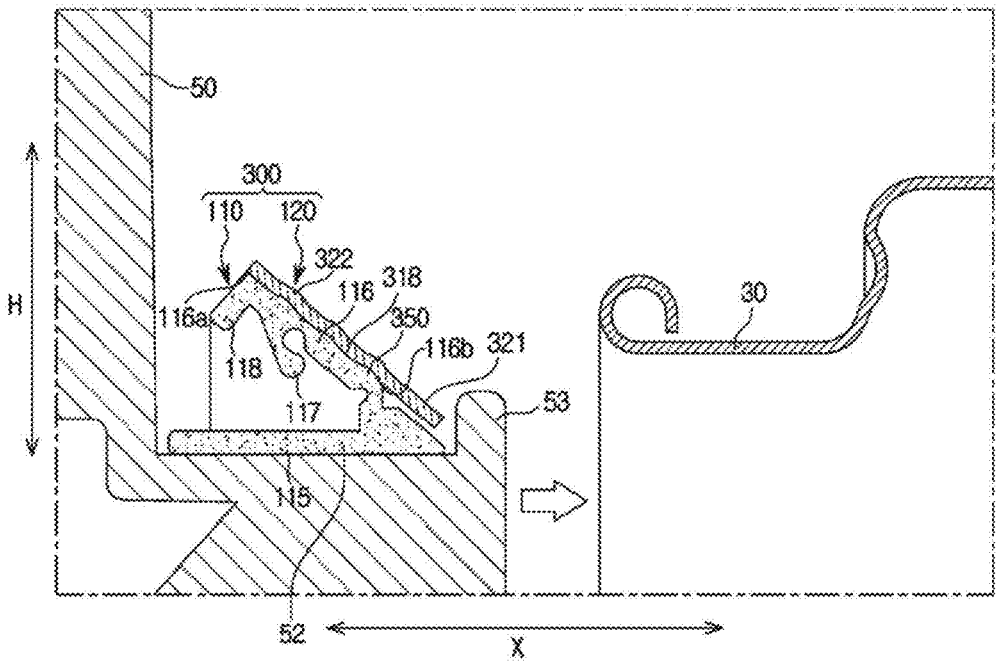
FIGS. 7A and 7B are views illustrating a clothes dryer according to still another embodiment of the disclosure, which shows states of a sealing member before and after a front support frame and a drum are coupled.
Figure 7B:
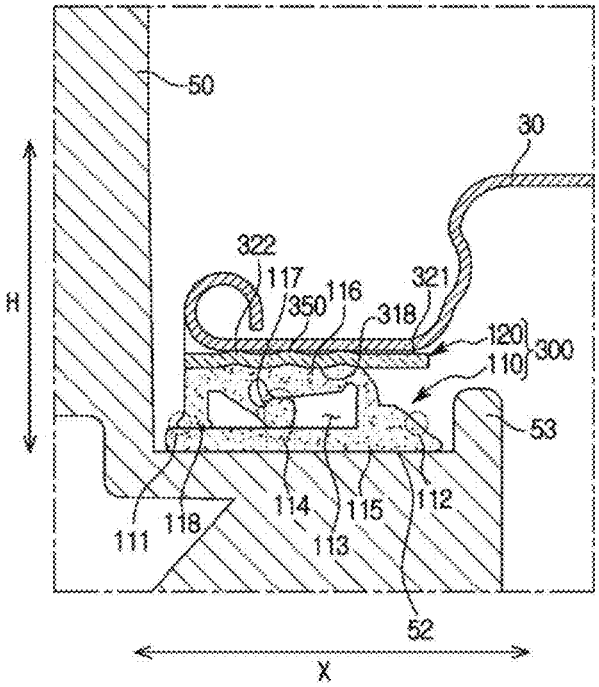

FIGS. 7A and 7B are views illustrating a clothes dryer according to still another embodiment of the disclosure, which shows states of a sealing member before and after a front support frame and a drum are coupled. In the following description, parts identical to those described in FIGS. 5A and 5B may be omitted, and may be assigned the same reference numerals.

Referring to FIGS. 7A and 7B, an extension portion 116 may include a plurality of protrusions 350. Specifically, the extension portion 116 includes a seal cover coupling surface 318 to which the seal cover 120 is coupled, and the plurality of protrusions 350 may be formed on the seal cover coupling surface 318.

The seal cover 120 may include a drum counterpart surface 321 facing the inner surface of the drum 30. In other words, the seal cover 120 may include the drum counterpart surface 321 facing the inner surface of the opening of the drum 30. Uneven portions 322 corresponding to the plurality of protrusions 350 may be formed on the drum counterpart surface 321. In this case, the sealing member 300 may make line contact with the inner surface of the drum 30 by the unevenness portion 322 of the seal cover 120. As such, when the unevenness portion 322 is formed on the seal cover 120, the sealing between the sealing member 300 and the inner surface of the drum 30 is maintained while minimizing the resistance due to the contact between the sealing member 300 and the inner surface of the drum 30.

In the embodiments described above, all configurations of the seal body 110 may be integrally formed with each other.

Although few embodiments of the disclosure have been shown and described, the above embodiment is illustrative purpose only, and it would be appreciated by those skilled in the art that changes and modifications may be made in these embodiments without departing from the principles and scope of the disclosure, the scope of which is defined in the claims and their equivalents.

The invention claimed is:

1. A clothes dryer comprising:

a cabinet having an inlet;

a support frame having a laundry inlet corresponding to the inlet and disposed inside the cabinet;

a drum rotatably disposed inside the cabinet and having an opening corresponding to the laundry inlet; and a sealing member disposed between the laundry inlet of the support frame and the opening of the drum, wherein the sealing member includes:

a seal body having an elastic material, and the seal body including:

a base portion seated on a seal body seating portion formed on the laundry inlet of the support frame, an extension portion extending from an end portion of the base portion in a bent shape so as to face an inner surface of the opening of the drum, a lip portion extending from an end portion of the extension portion and bent toward the base portion, a first end portion formed by overlapping the base portion and the lip portion, a second end portion formed by overlapping the base portion and the extension portion, a hollow formed between the first end portion and the second end portion, and at least one protrusion portion extending from the extension portion toward the base portion and contacting the base portion and the extension portion so as to divide the hollow into a plurality of spaces, wherein the lip portion has a length shorter than the extension portion, and a front end portion of the drum is supported by the support frame.

2. The clothes dryer of claim 1, wherein the seal body seating portion is along a circumference of the laundry inlet.

3. The clothes dryer of claim 1, wherein the sealing member further includes a seal cover coupled to the extension portion and having a fabric material.

4. The clothes dryer of claim 3, wherein the seal cover is in surface contact with the inner surface of the opening of the drum.

5. The clothes dryer of claim 3, wherein the seal cover includes a plurality of protrusions in contact with the inner surface of the opening of the drum.

6. The clothes dryer of claim 3, wherein the extension portion includes a seal cover coupling surface to which the seal cover is coupled, and the seal cover coupling surface is provided with a plurality of protrusions.

7. The clothes dryer of claim 6, wherein the seal cover includes a drum counterpart surface that faces the inner surface of the opening of the drum, and the drum counterpart surface is provided with an uneven portion corresponding to the plurality of protrusions.

8. The clothes dryer of claim 1, wherein the support frame includes a separation preventing step protruding from the seal body seating portion and configured to prevent the seal body from being separated from the seal body seating portion.

9. The clothes dryer of claim 1, wherein the seal body further includes an intermediate wall formed by overlapping the base portion, the extension portion, and the at least one protrusion portion.

* * * * *